United States Patent [19]

Eagar

[11] 4,170,320

[45] Oct. 9, 1979

[54] BEVERAGE CONTAINER

[76] Inventor: Lee J. Eagar, P.O. Box 297, Hurricane, Utah 84737

[21] Appl. No.: 850,929

[22] Filed: Nov. 14, 1977

[51] Int. Cl.[2] ..... B67D 5/62

[52] U.S. Cl. ..... 222/146 C; 220/374

[58] Field of Search ..... 222/146 C, 131; 215/310; 220/373, 374

[56] References Cited

U.S. PATENT DOCUMENTS

| | | | |
|---|---|---|---|
| 1,946,962 | 2/1934 | Block | 222/146 C |
| 2,468,661 | 4/1949 | Gladstone | 222/146 C |
| 2,687,619 | 8/1954 | Hurt | 222/146 C |
| 3,910,461 | 10/1975 | Eagar | 222/131 |

FOREIGN PATENT DOCUMENTS

| | | | |
|---|---|---|---|
| 416732 | 7/1925 | Fed. Rep. of Germany | 220/374 |

*Primary Examiner*—Stanley H. Tollberg
*Attorney, Agent, or Firm*—M. Ralph Shaffer

[57] ABSTRACT

An improved beverage container for dispensing carbonated beverages, for example. The container is provided with a housing shell having a lid of unique design, and also an interior apertured container suitable for receiving dry ice or other solid cooling agent. This interior apertured container is uniquely provided with an annular wall having slots that can be readily produced in an injection molding operation. A ring is provided both to preserve the integrity of this interior container and also to serve as a support for co-action with a lid of the beverage housing shell. The housing shell itself is provided with a lid having a baffle, the same being provided with gas vents and having a baffle beneath such vents for preventing the contained fluid from sloshing about proximate the vents and also for generally retaining foam beneath the baffle area. The baffle itself, however, is provided with a series of apertures to provide gaseous communication as between the interior of the beverage container and the gas vents of the lid. The baffle is either flat or disc shaped, the latter being especially useful for return of condensations that might appear upwardly of such baffle through use of the container.

6 Claims, 7 Drawing Figures

BEVERAGE CONTAINER

FIELD OF INVENTION

The present invention relates to beverage containers and, more particularly, to a new and improved beverage container for carbonated drinks, for example, wherein an interior dry ice container is uniquely configured for high-speed manufacturing production and proper operation, a lid being provided the beverage container which will permit the escape of gas from the container interior to avoid pressure buildup, while at the same time generally precluding foaming or dripping proximate the lid vents leading to the exterior.

DESCRIPTION OF PRIOR ART

The present invention is somewhat related to, but is an improvement over the inventor's prior U.S. Pat. No. 3,910,461. Other patents in the field of container structures include the following: U.S. Pat. Nos. 235,044, 1,187,002, 1,778,248, 1,874,091, 1,987,323, 2,096,088, 2,105,339 and 2,285,096.

All of the above patents fail to teach a convenient and functional dry ice container, for example, which can be easily made by one step injection molding techniques; however, some interior containers, such as that shown in FIG. 4 of the inventor's prior U.S. Pat., No. 3,910,461, teach necessary apertures in the side wall of the container as being circular or closed. For such a construction, the container cup must first be formed and the holes later drilled in the side walls. The inventor, in contrast, has arrived at a new design involving slots, such slots being open-ended, at least at the mouth of the container, so that the positive mold can be easily withdrawn by simple longitudinal movement so as to leave the slots exposed; this is a marked improvement and marked reduction in manufacturing costs for containers having side wall apertures that are closed or circular, for example. A further deficiency in prior containers is that there has been absent an aperture baffle beneath any side venting apertures with a lid. The inventor's prior patent above reference teaches a valve escape of accumulated gas under pressure within the container, directly upwardly through the upper surface of the lid by virtue of a valve. The present invention avoids valve structures and moves lid vents away from and out of line with any baffle apertures, this so as to insure a circuitous route for the gases and thereby provide for condensation from any slight foaming that may appear above the lid baffle to drain back into the container, and this without chancing any foaming to occur around the side of the lid or proximate the lid handle. None of the above patents teaches this important concept.

BRIEF DESCRIPTION OF PRESENT INVENTION

According to the present invention, therefor, the beverage container has a lid which is provided with an interior baffle that is fixed. Disposed above the baffle, remote from any baffle apertures, are gaseous vent holes which are mutually spaced, horizontally, about the lid. The baffle used tends to prevent a sloshing about of liquid proximate the lid at its vent apertures and in particular, keeps foam away from the remotely disposed vent apertures that are purposefully removed from any in-line relationship with the baffle vents. Accordingly, there is no possibility of foaming to occur proximate the handle of the lid; likewise, foaming is largely if not totally eliminated from the side vents of the lid. The dry ice or other solid cooling-agent container is provided with an annular mouth support ring and also open-ended slots that are open-ended proximate such ring. This serves the purpose of providing or producing slots in the container at the same time the container is molded, with the container being easily withdrawable, and the positive die easily withdrawable from the slots provided, thereby adapting the container structure uniquely to injection molding techniques in a single-step operation.

OBJECTS

Accordingly, a principal object of the present invention is to provide a new and improved beverage container.

A further object is to provide a beverage container of unique design that is suitable for carbonated or carbonating drinks.

A further object is to provide in a beverage container an interior, dry-ice or other solid cooling agent container, the same having slotted sides produced in a manner such that the slots are open-ended proximate the container mouth, thereby facilitating a very rapid manufacturing operation.

A further object is to provide in a beverage container a lid, said lid being vented, without valves, annularly about its side and having an apertured baffle which largely prevents foaming to rise upwardly proximate such vents and which, in addition, is provided with apertures that are out of line with and remote from the primary lid gas-vents.

The features of the present invention which are believed to be novel are set forth with particularity in the appended claims. The present invention, both as to its organization and manner of operation, together with further objects and advantages thereof, may best be understood by references to the following description, taken in connection with the accompanying drawings in which:

BRIEF DESCRIPTION OF DRAWINGS

In FIG. 1 the beverage container can comprise a housing shell 11, lid 12, and an apertured container 13.

Housing shell 11 is provided with the usual valve 13A which is provided with flow release button 14. Valve 13A is conventional and may take any one of several forms extant in connection with current water jugs and the like. Such valve 13A is mounted in aperture 14 of the housing shell 11 in the usual manner. Such housing shell 11 may be made as a unitary shell or a split shell having the segments thereof cemented, bonded or otherwise secured together.

Figure 1:
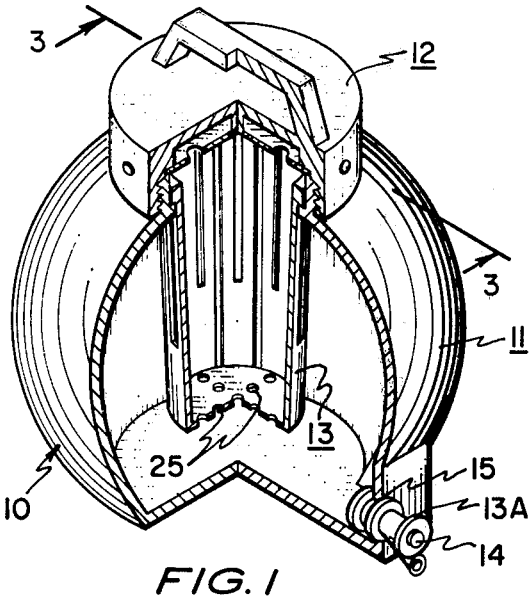
FIG. 1 is a perspective view, partially broken away, of a beverage container constructed in accordance with the principles of the present invention.
Figure 2:
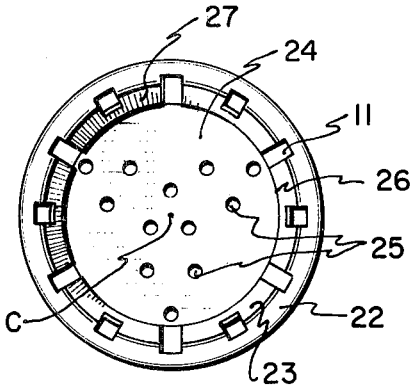
FIG. 2 is a top plan of the interior dry ice container of the invention shown in FIG. 4.
Figure 4:
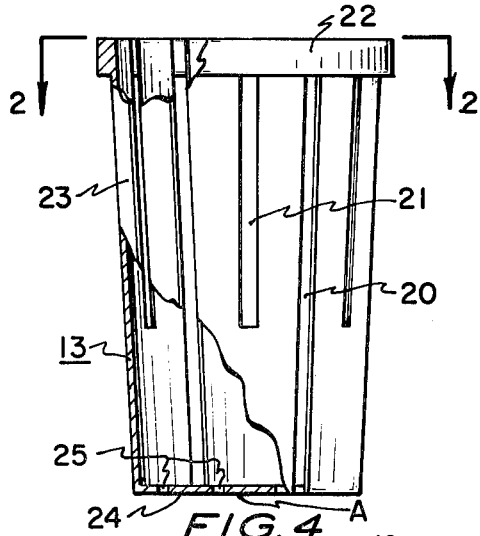
FIG. 4 is a fragmentary side elevation of the interior dry ice container of FIG. 1 and FIG. 2.
Figure 5:
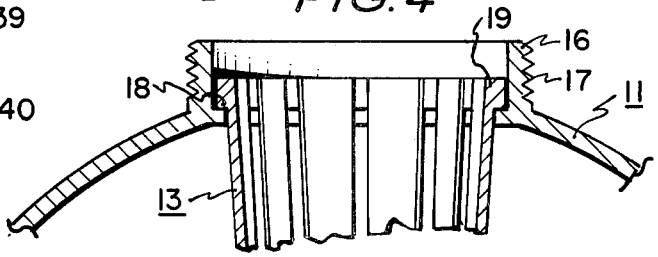
FIG. 5 is an enlarged fragmentary detail, shown in section, of the upper portion of the housing shell of the structure.

FIG. 5 illustrates that housing shell 11 includes a top 16 that is annular in form and threaded at 17. Annular interior shoulder 18 may be segmented or unitary and in any event retains the upper lip or ring 19 of apertured container 13. The apertured container 13, see FIG. 4 as well as FIG. 1, is provided as a convenient apertured receptacle for dry-ice, i.e., carbon dioxide in its solid state, or some other solid coolant. The apertured container has a series of elongate slots 20 and also a series of shorter slots 21, the slots 20, 21 being elongate and individually coplanar with the cup-like container's central axis C. These slots are for the purpose of providing communication with the fluid disposed in housing shell 11. Likewise, as the housing shell is transported from place to place, the slight sloshing about of the liquid will pass through the slots of the apertured container to further increase the cooling effect of the dry ice upon the liquid within housing shell 11. While the slots can vary in length from that shown, it is deemed preferable for certain ones of the slots to be foreshortened as indicated in order to preserve the essential strength of the container in its holding capacity and capability for the solid coolant or cooling agent to be retained thereby.

Such apertured container 13 comprises a ring 22 integral with or attached to an annular side wall 23. The annular side wall preferably has a slight draft angle so that such side wall is in fact tapered inwardly and represents a frustoconical section. Base 24 is integral with annular side wall 23 and is provided with a series of apertures at 25. These apertures may be circular as indicated. It is noted that the periphery 26 of the base is co-extensive with and joins the inner surface 27 of such annular side wall. One must be careful to note, therefore, that the subject container 13 is unique and is very readily molded by customary injection molding techniques. The positive or inner mold can simply have rib-like raised protuberances forming the several slots 20, 21; the negative mold can be used simply to form the exterior surface of annular side wall 23 and aid in configuring the annular ring 22. The material can be fed into the composite mold structure at A in FIG. 4 to fill to the cavity formed by the two molds when the same are placed in their molding condition. Then, once the material is set, the positive mold can simply be pulled, within the interior of the exterior mold, so that the part can be very easily and quickly withdrawn. Hence arises the very rapid manufacturing technique possible, this by virtue of the slits in the walls that facilitate very rapid container fabrication in highspeed, quantity production. Pins or other means can be used to produce the round apertures, for example, in the base 24. It is noted in passing that the apertured container 13 as set forth is a great improvement over any prior-art container having circular apertures in the annular side wall or indeed any type of aperture, not slits, which requires a separate fabrication operation once the principal form of the container is made.

There remains for consideration a structure lid 12. Lid 12 includes an integral handle 28 as integral with a top portion 29. Top portion 29 includes an annular flange 30 that is interiorly threaded at 31, such threads cooperating with exterior threads at 17 in FIG. 5 relative to the housing shell 11.

Figure 6:
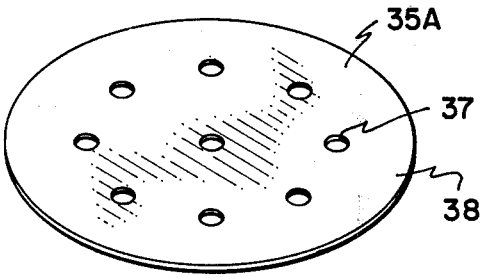
FIGS. 6 and 7 illustrate alternate baffles for inclusion in the lid design shown in FIG. 3.

Depending centrally from top 29 is a depending post 32, the same being shouldered at 33 to provide a pin portion 34. A baffle is positioned at 35 and may take the form as shown at 35A in FIG. 6 or at 35B in FIG. 7. In FIG. 6, the baffle 35A includes a plurality of apertures 37 disposed transversely within a flat disc 38.

Figure 7:
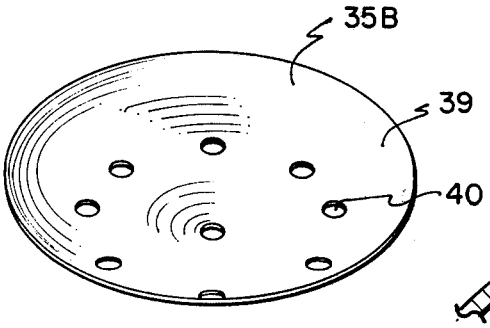

In FIG. 7 the baffle 35B comprises a dish-shaped member 39 having a series of apertures 40. In certain applications the dish shaped disc at 35B in FIG. 7 may be superior since it will allow condensed foam to be proceed downwardly into the apertured area of such disc to drop down into the container. The baffle 35A of FIG. 6, however, will operate very well, not only for the return of beverage condensations but also will tend to keep, in general, the liquid with any foaming in the interior of the container beneath the lower surface of the baffle. Apertures 41 are venting apertures in lid 12.

Figure 3:
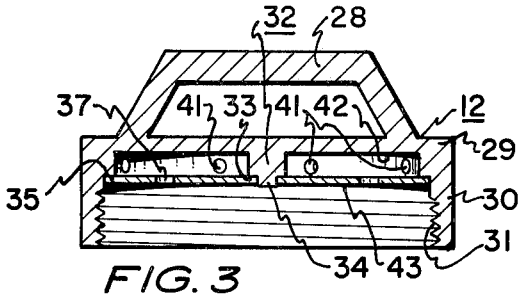
FIG. 3 is a vertical transverse section of the lid of the invention and is taken along the line 3—3 in FIG. 1.

In assembly, a selected baffle as at 35A or 35B in FIG. 6 and FIG. 7 is positioned over the pin portion 34 of post 32 in FIG. 3, and then an iron or other hot means is used to heat-weld the baffle in place over the post 32 as indicated in FIG. 3. The apertures 37 and 40, as the case may be, co-act with apertures 41 in reducing pressure within the housing shell 11. The baffle at 35 in FIG. 3, however, keeps the liquid in general from sloshing up toward surface 42 and in proximity with apertures 41; rather, the baffle tends to keep both liquid and foam in an area beneath the lower surface 43 of the baffle, thereby preventing oozings of liquid and foam out of gas-vent apertures 41.

In operation, the user first fills, approximately three-quarters full, the container with desired liquid, such as rootbeer or a rootbeer liquid mixture. Thereafter, dry ice is introduced into the apertured container 13 and the container allowed to come to rest onto shoulder 18 in the manner suggested in FIG. 5. The lid 12 is then screwed over the top 16 of the housing shell 11. Soon the dry-ice will cool the liquid so that the same will be very savored and delicious to drink. Apertures 41 and 37, 40 can be sized appropriately to maintain some minimum gas pressure within the container, as desired. However, the baffle at 35 within the lid prevents the liquid from sloshing about proximate apertures 41 and leaves such apertures essentially free as gas vents.

While particular embodiments of the present invention have been shown and described, it will be obvious to those skilled in the art that changes and modifications may be made without departing from this invention in its broader aspects, and, therefore, the aim in the appended claims is to cover all such changes and modifications as fall within the true spirit and scope of this invention.

I claim:

1. A beverage container including, in combination: an outer housing shell having a fluid-flow release valve; a lid removably secured to said housing shell, said housing shell having an interior shoulder disposed beneath said lid; and an interior, perforate, molded, unitary, solid-cooling-agent container provided with an upper, outwardly radially extending ring-like flange resting upon said interior shoulder, and wherein said interior container has an upper mouth and is elongate and cup-configured, having a central axis, and, further is provided with a plurality of sidewall slots open-ended at said mouth and individually and respectively coplanar with said axis.

2. A beverage container including, in combination: an outer housing shell having a fluid-flow release valve; a lid removably secured to said housing shell, said housing shell having an interior shoulder disposed beneath said lid; and an interior, perforate, molded, unitary, solid-cooling-agent container provided with an upper, outwardly radially extending ring-like flange resting upon said interior shoulder, and wherein said lid has a centrally-suspended baffle provided with perforations and an annular ring-like flange provided with plural vent holes disposed remote from and out of registry with respect to said perforations.

3. For a beverage container, a molded lid having an annular side flange and a top integral therewith, said top having a central, depending, baffle-supporting abutment, a handle fixedly disposed with respect to and upstanding from said top, a perforate baffle centrally secured to said lid at said abutment proximate said side flange and beneath said top, said annular side flange having gas-venting apertures.

4. The structure of claim 3 wherein said baffle is concave upwardly.

5. The structure of claim 3 wherein said central, depending, baffle-supporting abutment of said top comprises a depending post having a lower end of reduced cross-section defining a shoulder, said baffle being secured to said post, mounted over said reduced end, and abutting said shoulder.

6. The structure of claim 5 wherein said annular side flange has an interior shoulder, said baffle peripherally engaging said shoulder.

* * * * *